US006459858B1

(12) United States Patent
Davis

(10) Patent No.: US 6,459,858 B1
(45) Date of Patent: Oct. 1, 2002

(54) ELECTROPHOTOGRAPHIC IMAGING DEVICE HAVING INK PRINTING DEVICE FOR PRINTING OF METERED POSTAGE

(75) Inventor: Susan M. F. Davis, Nampa, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/874,425

(22) Filed: Jun. 4, 2001

(51) Int. Cl.[7] ..... G03G 15/00; G03G 21/00

(52) U.S. Cl. ..... 399/2; 270/1.03; 347/2; 399/110; 705/401

(58) Field of Search ..... 399/2, 1, 130, 399/139, 107, 110; 347/2; 705/401, 408

(56) References Cited

U.S. PATENT DOCUMENTS 5,384,886 A * 1/1995 Rourke ..... 707/523
5,437,441 A * 8/1995 Tuhro et al. ..... 270/1.03
6,026,385 A * 2/2000 Harvey et al. ..... 705/408
6,086,182 A * 7/2000 Nambudiri ..... 347/23

* cited by examiner

*Primary Examiner*—Sophia S. Chen

(57) ABSTRACT

The present invention provides for an imaging apparatus having an electrophotographic imaging section to generate an image on media using an electrophotographic imaging process, and a meter stamp printer to print a meter stamp on the media. The meter stamp printer can be an ink jet printer, and can be detachably connectable to the electrophotographic imaging apparatus. The imaging apparatus can include an electrophotographic print engine to generate the image on the media using the electrophotographic imaging section. The meter stamp printer can include a meter stamp print head responsive to a meter stamp print engine. The imaging apparatus can further include a meter vault program, and a meter vault memory to store a value of postage to be printed by the meter stamp printer. The meter vault program can authorize the meter stamp printer to print the meter stamp on the media.

7 Claims, 6 Drawing Sheets

ELECTROPHOTOGRAPHIC IMAGING DEVICE HAVING INK PRINTING DEVICE FOR PRINTING OF METERED POSTAGE

FIELD OF THE INVENTION

The invention claimed and disclosed herein pertains to printing of metered postage, and more particularly to printing metered postage facilitated by an electrophotographic imaging device.

BACKGROUND OF THE INVENTION

The present invention pertains to postage meters, which are devices used to print postage on envelopes or the like in the form of a "meter stamp". The use of a postage meter avoids having to apply stamps to the item to be mailed. Postage meters can print one or more denominations of postage, and can display the amount of postage used and the amount remaining. A meter locks (i.e., will not authorize the printing of a meter stamp) when no postage or minimal postage remains. The use of a postage meter in the United States is governed by United States Postal Service ("USPS") regulation P030, which describes the use and specifications of postage meters and meter stamps. Many foreign countries have similar regulations pertaining to the printing of postage using a postage meter.

In the United States, one must obtain a license to possess a meter and then select a meter and have the meter set. Postage meters are available only by lease from authorized manufacturers. The USPS holds manufacturers responsible for the control, operation, maintenance, and replacement of their meters. No entity other than the manufacturer may possess a postage meter without a valid USPS postage meter license and a rental agreement with the meter manufacturer. A customer may not possess a postage meter before the USPS sets, seals, and checks it into service. A meter generally must be taken to the licensing post office to be reset by payment for additional postage. However, the USPS Computerized Remote Postage Meter Resetting System ("CMRS") allows certain meters to be reset electronically at the licensee's place of business. This can be done through the use of a modem or a network interface card or the like.

As mentioned, postage can be paid by printing metered postage on any class of mail (except periodicals). Metered postage (printed meter stamps) must be legible and not overlap. Metered postage must be printed or applied in the upper right corner of the envelope, address label, or tag. Meter stamp designs (types, sizes, and styles) must be those specified when a meter is approved by the USPS for manufacture. In all usages, a meter stamp must show the city and state designation of the licensing post office, the meter number, and the amount of postage. Fluorescent red ink is mandatory for metered postage on letter-size metered mail. Failure to use fluorescent ink may lead to the revocation of the meter license. At the present time, a meter stamp cannot be printed using toner in an electrophotographic printing process.

A postage meter comprises a "vault", which is the device which stores the value of the postage which has been set on the meter (and paid for by the licensee), and more specifically, the remaining value of postage following any use of the meter. Modern postage meter "vaults" are typically electronic devices which include a vault memory (such as a readable-writeable random access memory ("RAM")) configured to store the value of postage remaining in the meter. A primary concern of the licensing authority (typically, a national post office) in the use of postage meters is ensuring that the licensee debits the vault for usage of postage, and further that the licensee does not increase the value of postage recorded in the vault through means other than those authorized by the licensing authority. To this end, access to the vault is provided through a vault program, which is typically executed by a vault processor. The vault program is provided with an encryption or encoding routine allowing only an authorized entity to increment the value stored in the vault. Likewise, the vault program is provided with an accounting routine to subtract value from the vault when postage is printed using the postage meter. The accounting routine can also provide a user with information regarding the balance available in the vault.

When a meter stamp is to be printed using an electronic printing device, such as an ink jet printer, then an additional concern of the licensing authority is ensuring that the meter stamp printing device only prints a meter stamp which is authorized by the postage meter. That is, the licensing authority desires to prevent persons from printing metered postage using the printing device unless the printing causes the meter vault to be debited by the amount of the printed meter stamp. To this end the meter stamp printing device can be provided with an electronic "lock" which can only be disabled by an encrypted signal from the vault processor. The meter stamp printing device cannot print a meter stamp until the electronic lock has been disabled. Accordingly, the vault program can further include a meter stamp printing routine. The meter stamp printing routine can generate an electronic file of the meter stamp image to be printed, including the value of the postage, the origin of the stamp (city and state), and any other characteristics to be printed as part of the meter stamp. The meter stamp printing routine can then provide the meter stamp printing file with an encrypted "key", which can only be used by the meter stamp printing device. The "key" unlocks the meter stamp printing device, allowing it to print the meter stamp printing file. After printing, the meter stamp printer again becomes "locked" so that unauthorized printing of postage does not occur.

Prior to the advent of electronic meter stamp printing, meter stamps were almost exclusively printed by apparatus which employ mechanical print elements. These mechanical printing elements are either fixed (such as the city and state of origin of the meter stamp), or are variable and set by hand (such as the postage value and the date, which were set by a plurality of wheels). The mechanical print elements are used to transfer the postage ink from a medium (such as a reservoir or a ribbon) to the item being printed with the meter stamp. However, the use of electronic meter stamp printing allows the formatting and printing of the meter stamp to be performed automatically, saving user time.

U.S. Pat. No. 5,696,828, issued to Cordery et al. on Dec. 9, 1997, entitled, "DIGITAL POSTAGE METER SYSTEM", and incorporated herein in its entirety by reference, describes a postage meter having a vault and an ink jet print head. A control system coordinates the printing of metered postage (as authorized from the vault) by the ink jet print head using encrypted communications to thereby ensure security of the system.

U.S. Pat. No. 5,815,172, issued to Sungwon R. Moh on Sep. 29, 1998, entitled, "METHOD AND STRUCTURE FOR CONTROLLING THE ENERGIZING OF AN INK JET PRINTHEAD IN A VALUE DISPENSING DEVICE SUCH AS A POSTAGE METER", discloses a secure method, and apparatus for implementing the method, to print metered postage using an ink jet print head.

U.S. Pat. No. 6,085,181, issued to Linda V. Gravell et al. on Jul. 4, 2000, entitled, "POSTAGE METERING SYS- TEM AND METHOD FOR A STAND-ALONE METER OPERATING AS A METER SERVER ON A NETWORK", and incorporated herein in its entirety by reference, describes a postage meter that can print a meter stamp on any of several meter stamp printing devices connected to a network. Further, the postage meter can be reset using the USPS Information-Based Indicia Program ("IBIP") using a connection (such as a modem) to a data center authorized to issue postage to a postage meter. FIG. 3 of this patent shows how the meter, in the form of a postal security device ("PSD"), is in communication with an meter stamp printer via a host computer, such as a personal computer. The meter stamp printer can be an unsecured printer. The host computer is provided with a modem to allow postage to be purchased from a data center. The host computer is also provided with applications programs, in conjunction with a meter toolkit, allowing a user to select the desired postage and have the postage printed on media such as an envelope. The meter toolkit ensures the security of the printing of the meter stamp by the printer.

However, all of the prior art postage meter systems still require, in accordance with USPS regulations, that the meter stamp be printed using red fluorescent ink.

By and large, electrophotographic ("EP") imaging devices are the most popular form of imaging device used in homes and offices to print images such as documents and graphics images. By "imaging device" I mean a device configured to print an image on a sheet of printable media. Examples of imaging devices include printers, photocopiers, and so-called "all-in-one" machines, which typically incorporate the functionality of a printer, a photocopier, a facsimile machine, and a scanner all in a single device. Printable media (or "media") can include papers, labels, transparencies, card stock (such as a post card), and preformed media such as envelopes. Many printers can print addresses on envelopes using an application software package, such as Word 2000, available from Microsoft Corporation of Redmond, Wash. However, these EP imaging devices cannot print metered postage on printable media. Accordingly, if a user desires to add postage to an envelope or the like after printing the envelope with an address, the user must manually add postage (in the form of stamps, for example), or separately run the envelope through a postage meter which can print the meter stamp on the envelope.

EP imaging devices are well known in the art. However, I will provide here a brief, general description of an EP imaging device to facilitate later description of my invention. An EP imaging device includes a scanning section, also known as an exposure section, and a developing section. A photoconductive material, supported on a continuous transfer medium such as a belt or a drum, moves past the exposure section and the developing section. The photoconductive material is first charged to a base electrical potential. As the photoconductive medium passes by the exposure section, it is selectively discharged by a laser which is scanned across the moving transfer medium. This scanning is usually accomplished using a rotating polygon-sided mirror. The laser selectively discharges the photoconductive material in response to a digital file, which is representative of the image to be imagined on the media. (Alternately, the photoconductive material can be initially discharged to a base potential, and then selectively charged by the laser according to the digital file.) The image is thus formed on the photographic material in "pixels" of selectively exposed areas. Thereafter, the photoconductive material is moved past a toner cartridge in the developing section, and toner from the cartridge is attracted to the selectively exposed portions of the photoconductive material. The toner typically comprises small spherical particles (frequently plastic), or powder, or a liquid, all capable of receiving a static electrical charge to facilitate their movement from one point to another by electrostatic processes. The toner is then transferred from the transfer medium to the print media using an electrostatic discharge element, and is then subsequently fused to the media by a fuser. The fuser can use heat and/or pressure to fuse the toner to the print media. The print media is propelled by a series of powered rollers through a media path ("paper path") defined by a series of guides, and is then deposited in an output tray where it can be accessed by a user.

An EP imaging device can create an image on print media either in monochrome (typically black), or as a color image, typically using toners of cyan, yellow, magenta and black. However, as previously mentioned, there is currently no toner, or combination on toners, of a fluorescent color which is acceptable (at least by the USPS) for printing a meter stamp. Accordingly, an office or the like which has an EP imaging device, but which also desires to be able to print metered postage, must have both a separate EP imaging device, as well as a separate metered postage printer. Since each of these devices consumes a certain amount of space, the result can be a crowded office, or loss of valuable space which can be used for other purposes.

What is needed then is a postage meter which achieves the benefits to be derived from similar prior art postage meters, but which avoids certain of the shortcomings and detriments associated therewith.

SUMMARY OF THE INVENTION

The present invention provides for a meter stamp printer as part of, or as an attachment to, an imaging apparatus, and particularly an elecrophotographic ("EP") imaging apparatus or device having an electrophotographic printing section. Preferably, the meter stamp printer is an ink jet printer and has an ink jet print head and a meter stamp print engine to control the ink jet print head. The meter stamp print engine operates separately from an electrophotographic print engine which is used to print images using the electrophotographic printing section. The meter stamp print engine can be enabled by a postage meter which is external to the imagine apparatus. Alternately, the postage meter can be incorporated into the imaging apparatus as an expansion module. The imaging apparatus can be in communication with an external computer, such as a personal computer, which can be used to instruct the imaging apparatus, in conjunction with the meter stamp printing device, to print a meter stamp (using the meter stamp printing device) and/or an image (using the EP imaging section of the imaging apparatus) on a selected medium, such as an envelope or a post card.

In one embodiment the invention includes an imaging apparatus comprising an electrophotographic ("EP") imaging section capable of generating an image on media using an electrophotographic imaging process. The imaging apparatus further includes a meter stamp printer capable of printing a meter stamp on the media. Preferably, the meter stamp printer is an ink jet printer. The meter stamp printer can be a meter stamp unit detachably connectable to the imaging apparatus. The imaging apparatus can be, for example, a laser EP imaging device.

The imaging apparatus can also include a media inlet, a media outlet, and a media path defined between the media inlet and outlet, and through which the media is configured to pass. In this case the EP imaging section and the meter stamp printer can be positioned to be capable of respectively generating the image and the meter stamp on the media as the media passes through the media path. In this way, media (such as an envelope or the like) can be printed with an image, such as an address, as well as metered postage, by using the same apparatus, and in a single operation, such that postage does not need to be separately applied to the medium after (or before) the non-meter stamp image is printed on the medium.

The imaging apparatus can further include an EP print engine configured to generate the image on the media using the EP imaging section. Further, the meter stamp printer can comprise a meter stamp print engine and a meter stamp print head responsive to the meter stamp print engine. The meter stamp print head (which can be an ink jet print head) is configured to print the meter stamp on the media.

Further, the imaging apparatus can include a main processor and a meter vault. The meter vault can include a meter vault memory, and a meter vault program. The meter vault memory is configured to store a value of postage which can be printed by the meter stamp printer. The meter vault program is configured to authorize the printing of the meter stamp on the media using the meter stamp printer, and the main processor can be configured to generate the image on the media using the electrophotographic print engine. Specifically, the meter vault program can be configured to instruct the main processor to print the meter stamp on the media using the meter stamp print head (which is typically an ink-jet print head) when the printing of a meter stamp has been authorized by the vault processor. The meter stamp program thus assists in providing security to the vault memory so that unauthorized printing of a meter stamp is unlikely to occur.

The imaging apparatus can include a meter vault processor separate from the main processor. The meter vault program can be configured to instruct the meter vault processor to instruct the meter stamp print engine to print the meter stamp on the media using the meter stamp head when the printing of a meter stamp has been authorized by the meter vault program. A communication device can be provided to allow the main processor to receive postage value from a remote source (such as the Internet) and to save the postage value in the meter vault memory.

In one configuration the imaging apparatus is in communication with a printer driver program. The printer driver program can be configured to receive a print file comprising electronic representations of the image (such as a recipient address for an envelope) and the meter stamp. The printer drive program is configured to transmit the electronic representations of the (non-stamp) image to the electrophotographic print engine, and to transmit the electronic representations of the meter stamp to the meter vault program.

In another embodiment, the present invention provides for an imaging system having an imaging device comprising an electrophotographic imaging section capable of generating an image on media using an electrophotographic imaging process, and a meter stamp printer capable of printing on the media a meter stamp defined by a stamp value. The imaging system can further include a postage meter comprising a vault for storing a value of postage which can be printed by the meter stamp printer. The system can also have a computer configured to allow a user to instruct the imaging device to generate an image on the media using the electrophotographic imaging section, to print a meter stamp on the media using the meter stamp printer, and to obtain the stamp value from the meter vault. The meter stamp printer can be a meter stamp unit detachably connectable to the imaging device, and can print the meter stamp using an ink jet printer.

In one variation the imaging device includes an imaging device processor and an expansion module interface. The postage meter can be a module configured to be received within the expansion module interface, and the imaging device processor can perform the printing of the meter stamp as directed by the postage meter.

A third embodiment of the present invention includes an attachment for an electrophotographic imaging device. The imaging device has an electrophotographic imaging section capable of generating an image on media using an electrophotographic imaging process. The attachment comprises a meter stamp printer capable of printing a meter stamp on the media. Preferably, the meter stamp printer comprises an ink jet print head for the printing of the meter stamp using a designated fluorescent ink. The meter stamp printer can comprise a meter stamp print engine configured to cause the ink jet print head to print a meter stamp upon receipt of an instruction from a meter vault program.

These and other aspects and embodiments of the present invention will now be described in detail with reference to the accompanying drawings, wherein:

DESCRIPTION OF THE DRAWINGS

FIG. 5 is a depiction of an exemplary user interface display which can be used to allow the apparatus of FIGS. 1 and 3 to address and print a meter stamp on an envelope or the like.

DETAILED DESCRIPTION OF THE INVENTION

My invention provides methods and apparatus for printing a meter stamp on printable media using an imaging apparatus, and more particularly an electrophotographic ("EP") imaging apparatus or device. In its simplest form, the invention includes providing an imaging apparatus (having an EP imaging section) with a separate meter stamp printer that uses authorized ink to print a meter stamp, whereas the imaging apparatus uses the EP imaging section to generate other images. A single piece of printable media (such as an envelope) can be printed with an image using the EP imaging components of the imaging apparatus, as well as with a meter stamp using the meter stamp printer. Preferably, the meter stamp printer shares certain components with the EP imaging section. However, the security protocols to guard against unauthorized printing of a meter stamp can be maintained by use of a meter stamp program. The meter stamp printer can be integrated with the imaging apparatus, or it can be an add-on accessory which can be added to an EP imaging apparatus. A number of different configurations can be employed to implement the present invention, as will be described below.

The present invention uses an EP imaging apparatus to support (functionally and/or physically) a meter stamp printing unit. As described above, an EP imaging apparatus can be a printer, a photocopier, or any device which uses EP imaging components to generate an image on media, such as paper or the like, using an EP imaging process. The typical EP imaging apparatus uses the EP imaging components and process described above in the section entitled, "Background of the Invention" in order to generate an image. The meter stamp printer used in conjunction with the present invention does not use an EP imaging process to print the meter stamp, but instead uses an ink printing process, and preferably an ink-jet printing process. Ink-jet printing is well understood in the art, and need not be described herein in detail.

For purposes of the following discussion, I will use the term "meter stamp" to refer to any printing which signifies recognized postage value (i.e., recognized by a competent authority such as the U.S. Postal Service ("USPS")). A meter stamp can be printed directly on the object to be mailed, such as an envelope or a post card, and it can also be printed on a label or a tape and then subsequently applied to the object to be mailed.

Figure 1:
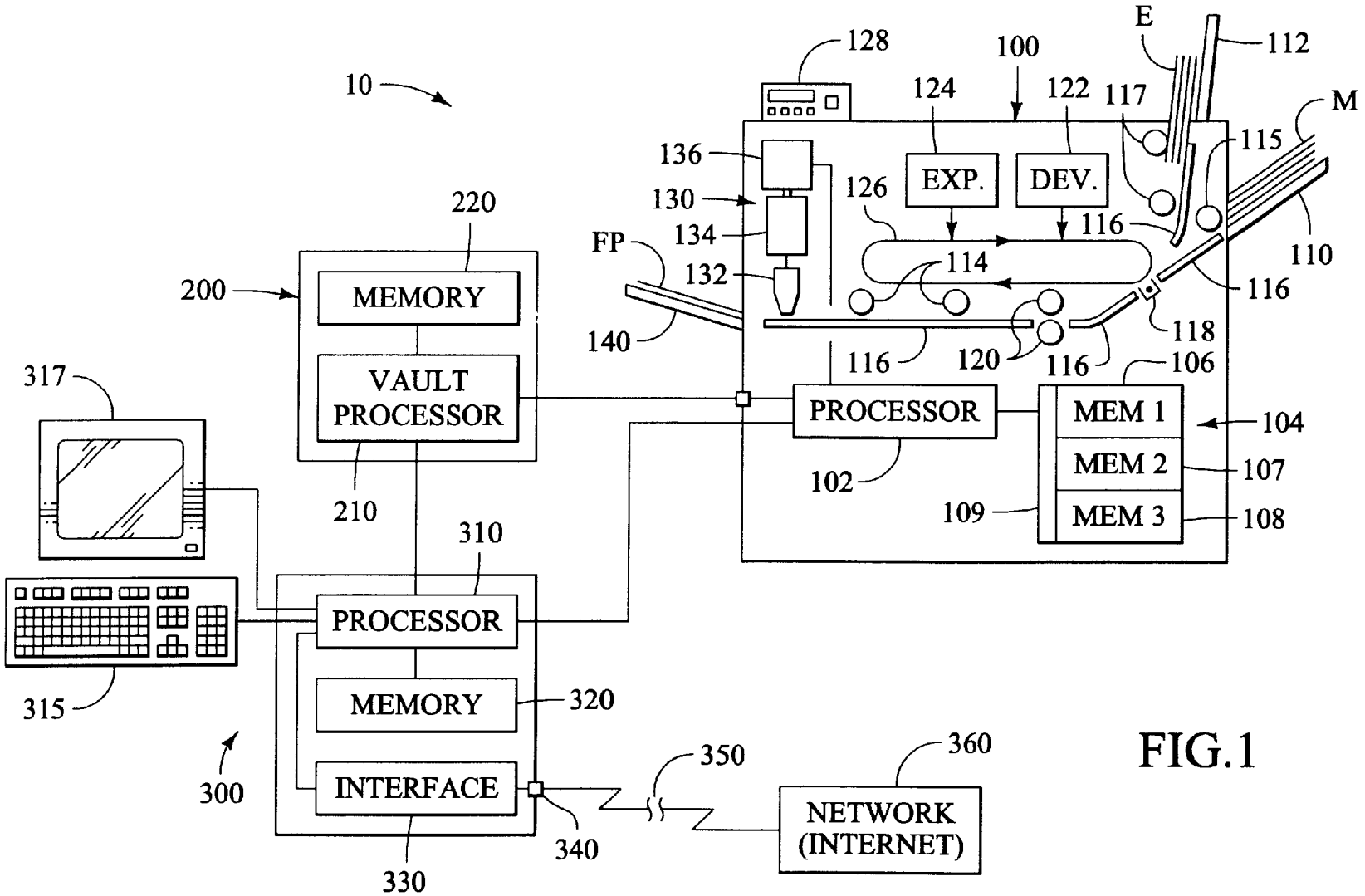
FIG. 1 is a schematic diagram of an imaging apparatus provided with a meter stamp imaging device, in accordance with a first embodiment of the present invention.

Turning now to FIG. 1, a first embodiment of the present invention is depicted in a schematic diagram. I will first describe the components of the imaging system 10 of FIG. 1, and I will then describe methods of operation of the system 10. The imaging system 10 of FIG. 1 comprises an imaging apparatus 100, a postage meter 200, and a computer 300, all of which are in electronic signal communication with one another. The imaging apparatus 100 comprises an electrophotographic ("EP") imaging section capable of generating an image on media using an electrophotographic imaging process. The imaging apparatus 100 further includes a meter stamp printer 130. The imaging apparatus 100 is configured to generate non-meter stamp images on printable media, and, or alternately, to print a meter stamp (metered postage) on the printable media. The printable media can be, by way of example only, paper "M", supported in the first media inlet (or tray) 110, and envelopes "E", supported in the second media inlet (or tray) 112. The printable media is moved by powered rollers 114, 115 and 117 through a media path in the imaging apparatus, defined by media guides 116. The imaged media is then deposited in the media outlet (or discharge tray) 140 as finished product "FP".

The EP imaging section comprises an exposure section 124 for exposing a photoconductive material supported on a rotating transfer belt 126, as well as a developing section 122 for developing the exposed photoconductive material. The developing process is typically performed using toner. The toner is then transferred to a sheet of media ("M" or "E") by corona discharge device 118, and is then fused to the sheet using the fusing section 120. It should be appreciated that the EP imaging apparatus 100 depicted in FIG. 1 is exemplary only, and that other configurations can be employed to equal effect. For example, the photoconductive material can be supported on a drum, rather than on the belt 126. Also, rather that use the "in-line" EP imaging process depicted in FIG. 1, the toner can be transferred from the photoconductor to an intermediate transfer device, such as a belt, and then from the intermediate transfer device to the sheet of media. This latter configuration is common in EP color printers to allow the (typically four) base colors to be applied on top of one another to provide for a larger pallet of colors.

The imaging apparatus 100, as depicted, also includes an imaging apparatus main processor 102, such as a microprocessor, and electronic imaging apparatus memory 104, such as read-write random access memory ("RAM"), and/or read-only memory ("ROM"), which can be accessed by the processor 102. The memory can be in the form of memory modules 106 (MEM 1), 107 (MEM 2), and 108 (MEM 3), which can be mounted into an expansion module interface 109. The imaging apparatus 100 can also include electronic memory (not shown) which is not installed in the expansion interface 109, and which can include memory for temporarily storing files to be printed by the imaging apparatus, as well as a set of basic operating instructions (in the form of a program) for use by the main processor 102 to perform basic operational functions. The use of memory modules allows additional RAM memory to be added to the imaging apparatus (for example, so that a very large amount of data can be queued for printing), as well as functional programs (typically in the form of ROM) to add additional functionality to the imaging apparatus 100. For example, many imaging apparatuses allow for additional attachments, such as a sheet sorter, a stapler, and a sheet feeder, to be added to a basic functional model of the imaging apparatus. To support these attachments, software (i.e., a program which can be executed by the processor 102) is often added in the form of a ROM memory chip to the expansion interface 109. When I use the expression "software", I mean not only an executable program which can be stored on volatile memory media, but also so-called "firmware", which can be a set of executable instructions recorded on a memory device such as a ROM microchip. For purposes of the present invention, the use of the expansion interface 109 allows a memory chip to be added to support the meter stamp printer 130, as will be described further below. Finally, the imaging apparatus 100 includes a user interface 128, which is in electronic communication with the main processor 102.

The meter stamp printer 130 is capable of printing a meter stamp (defined by a stamp value) on the printable media. The meter stamp printer comprises a print head 132 (such as an ink-jet print head), print head control components 134, and an ink reservoir 136 which can hold the red fluorescent ink used to print metered postage. The ink reservoir 136 can be in the form of a replaceable cartridge. The print head control components 134 include the electrical, electronic and mechanical components used to move ink from the reservoir 136 to the print head 132, and to manipulate the projection of ink by the print head 132 so as to print a meter stamp in accordance with a predetermined design and postage value. The operation of the print head control components 134 can be controlled by a meter stamp program, which can be contained within a memory module (such as MEM2, 107), and executed by the main processor 102.

The postage meter 200 comprises a vault memory 220 and a vault processor 210. The vault memory 220 can be RAM memory. Although there is no physical "vault", the vault memory can act as a meter "vault" for storing a value of postage which can be printed by the meter stamp printer 130. The vault processor can be considered as the "lock" on the "vault" to prevent unauthorized tampering with the value of the postage stored therein. The meter processor 210 is configured to execute a meter vault program which controls the addition of postage value to the vault memory 220, and also performs accounting functions for debiting the value of the postage in the vault as a result of use. The meter vault program can be stored in the meter vault memory 220. The operation of the meter vault program will be described more fully below.

The imaging system 10 also can include the computer 300. The computer 300 includes a processor 310, a computer memory 320, an interface 330, a user input device (such as keyboard 315), and a user display device (such as monitor 317). The computer 300 can be, for example, a personal computer or a workstation. The memory 320 can store applications programs which can be accessed by the user to perform various operations, such as authorizing the printing of a meter stamp using the meter stamp printer 130. The interface 330 can be a modem or a network interface card, or any other device which allows the user to communicate with a remote source, such as the Internet 360, via communication links 340 and 350. Accordingly, the computer 300 can be configured to allow a user to instruct the imaging apparatus 100 to generate an image (i.e., a non-meter stamp image) on printable media using the electrophotographic imaging section, and to print a meter stamp (defined by a stamp value) on the media using the meter stamp printer 130. Since the computer is in communication with the postage meter 200, the user can instruct the computer to obtain the stamp value from the meter vault (or more precisely, the meter vault memory 220).

It should be understood that FIG. 1 depicts but one arrangement of components that can be used to implement the present invention. I will discuss another imaging apparatus (400 of FIG. 3) which can also be used, as well as variations on the apparatuses 10 (FIG. 1) and 400 (FIG. 3), further below.

Figure 2:
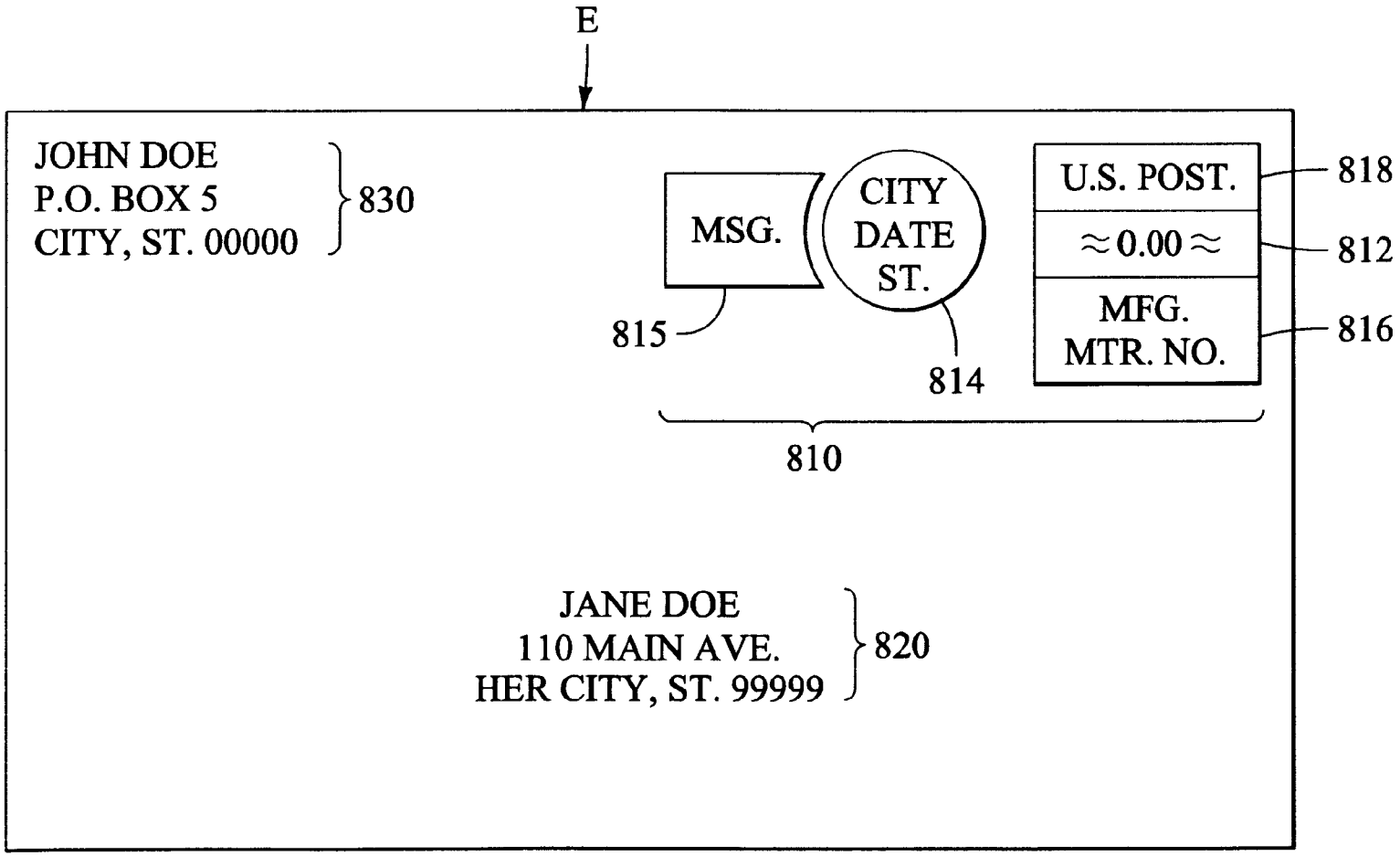
FIG. 2 is a depiction of an exemplary envelope which can be addressed, and printed with a meter stamp, using the apparatus of FIGS. 1 or 3.

The imaging system 10 of FIG. 1 can be used to either print an image on printable media using only the EP imaging section of the imaging apparatus 100, or to print metered postage on printable media using the meter stamp printer 130. However, preferably the imaging system 10 allows a user to print both an image, as well as metered postage in the form of a meter stamp, on the same piece of printable media using only the imaging apparatus 100. In this manner a user can, for example, print an address and postage on the same envelope using a single apparatus. For example, FIG. 2 depicts an exemplary envelope "E" that has been printed with a return address 830, a delivery address 820, and a meter stamp 810. All three components can be printed on the same envelope using the imaging apparatus 100. The meter stamp 810 includes the location (city and state) of the postage meter, as well as the date of printing of the meter stamp, identified by the medallion 814. The meter stamp also includes the identity 818 of the authorizing authority (here, the U.S. Postal Service), the name 816 of the manufacturer of the meter, and the value of postage 812 which is printed on the envelope. The meter stamp 810 can further include a variable message portion 815, which can be varied by the user to include messages such as a promotional message for a charity service. The selection for printing of all of the identified components on the envelope "E" can be accomplished by use of a user interface, such as the user interface display screen 600 of FIG. 5.

Figure 5:
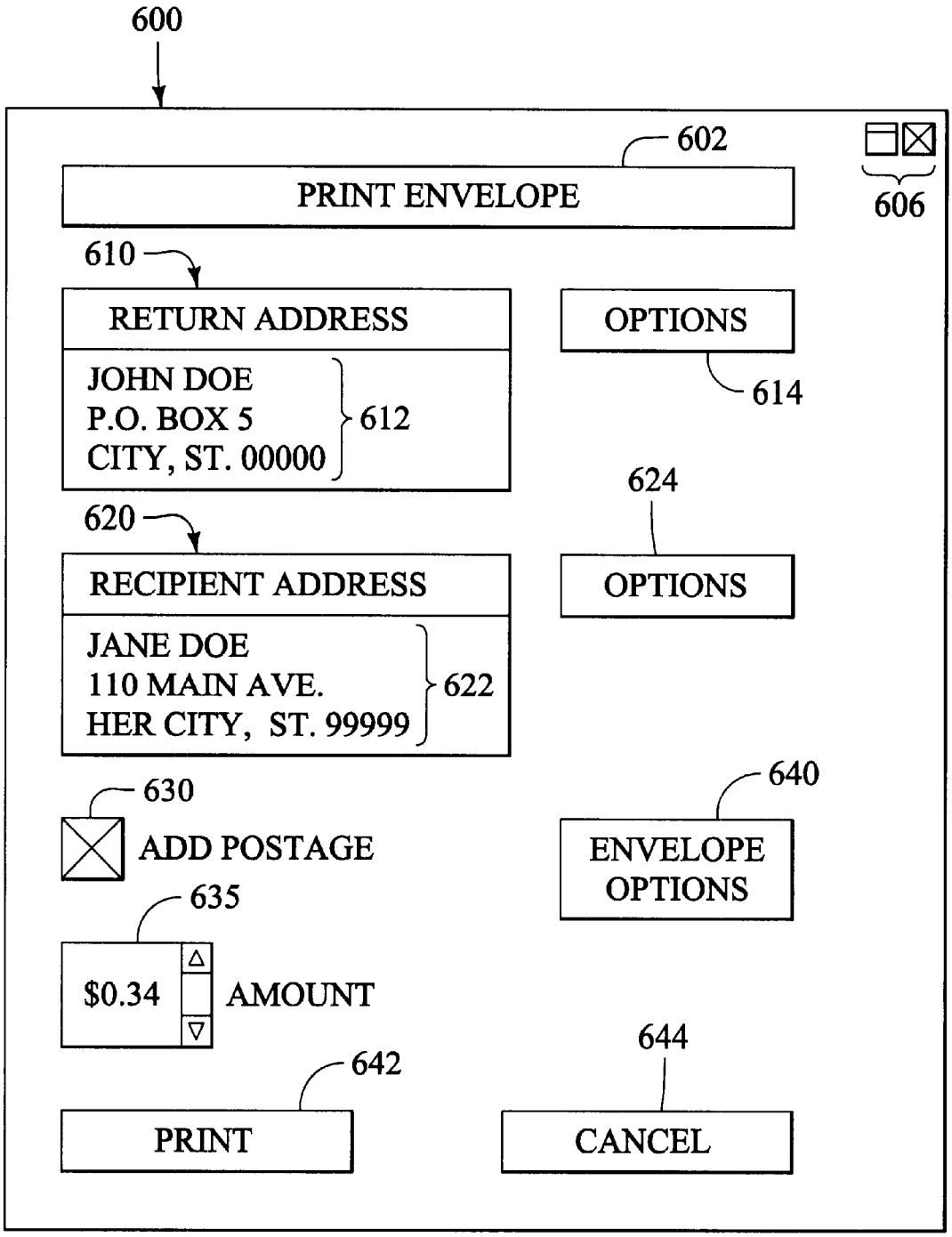

FIG. 5 depicts one possible display of a user interface 600 which can be used to generate an envelope such as envelope "E" of FIG. 2, using an imaging system such as system 10 of FIG. 1. The display 600 can be displayed using the display device 317 of FIG. 1, and can be generated by an applications program contained within the computer processor 310. The user interface 600 can be accessed via the keyboard 315 of FIG. 1. The display 600 of FIG. 5 can be generated by a word processing applications program, for example, and can be a feature offered as part of the applications program, or as part of an add-on feature to the applications program. The display 600 can be displayed, for example, when a user selects, "Print/Envelope" from the applications program. The display 600 includes a title box 602 displaying the function of the user interface (here, "PRINT ENVELOPE"). Boxes 606 allow the user to close or minimize the size of the interface 600. A RETURN ADDRESS box 610 allows the user to enter a return address 612 to be printed on the envelope. The return address will be printed using the EP components of the EP imaging apparatus. A return address "OPTIONS" button 614 allows the user to select different features for the return address, such as the appearance of the font. The interface 600 also includes a RECIPIENT ADDRESS box 620 to allow the user to enter the address 622 of the addressee. A recipient address "OPTIONS" button 624 allows the user to select different features for the recipient address, such as the appearance of the font. The interface 600 can also include an "ENVELOPE OPTIONS" button 640 to allow the user to access options for printing of the envelope, such as the size of the envelope, the orientation of the printing on the envelope, the number of envelopes to be printed, and so on. The feature particular to the present invention which is included in the user interface display 600 is the check-box 630 which allows a user to select whether or not to print a meter stamp on the envelope, and the postage value selection box 635 which allows the user to enter the value of the postage to be printed as part of the meter stamp. Once the user has made her selections, she can print the envelope using the "PRINT" button 642, or she can elect to cancel (and close) the user interface 600 using the "CANCEL" button 644.

Figure 3:
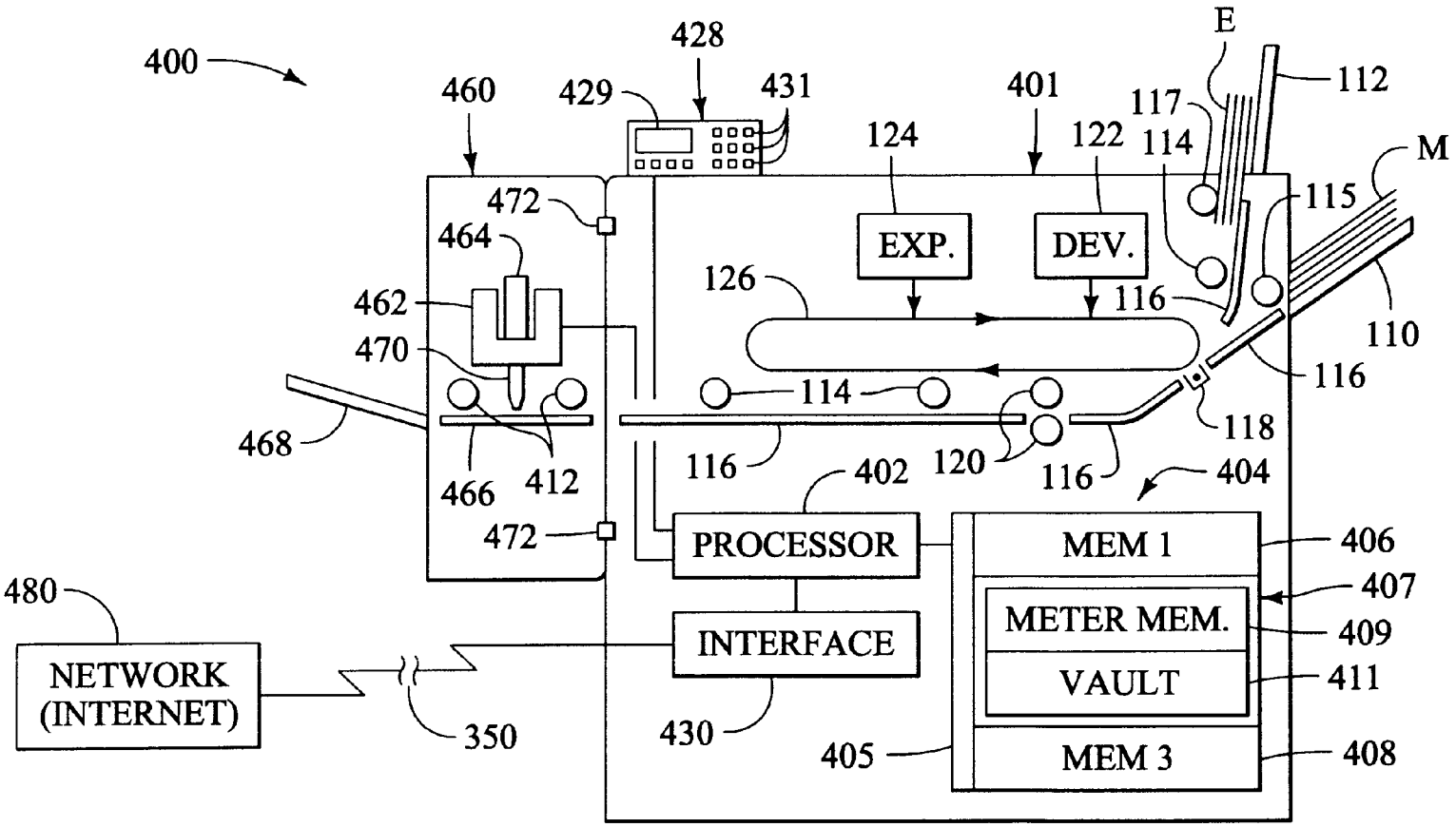
FIG. 3 is a schematic diagram of an electrophotographic imagining apparatus provided with a meter stamp imaging device, in accordance with a second embodiment of the present invention.
Figure 4:
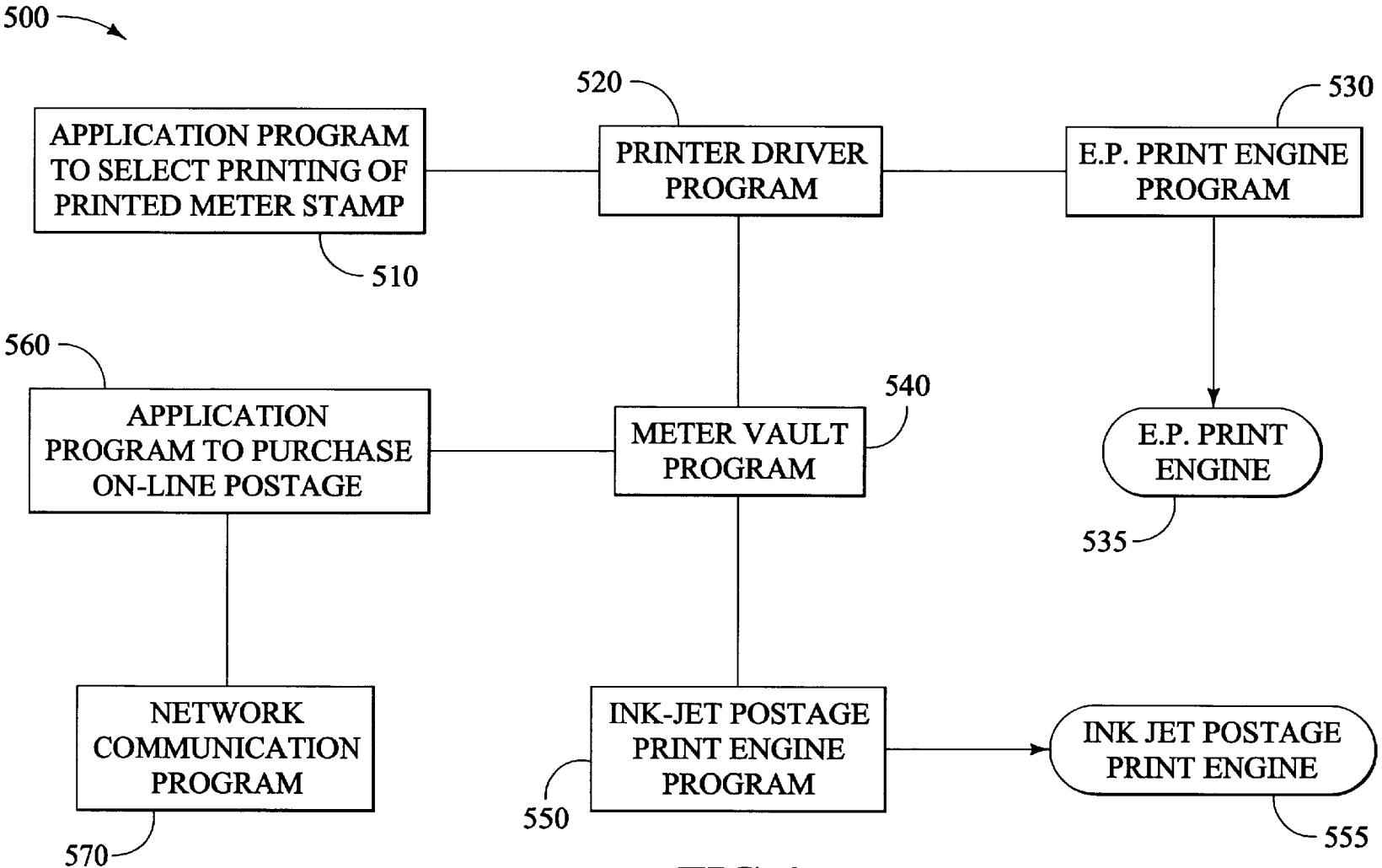
FIG. 4 is a schematic diagram depicting one architecture of software which can be used to implement the methods of the present invention.

Turning to FIG. 4, a schematic diagram 500 depicts the various "software" components that can be used to implement the present invention. As stated previously, when I use the expression "software", I mean a set of computer executable instructions, which can also be in the form of "firmware". The components can be stored as a series of computer executable steps in the various electronic memories of the apparatus 10 of FIG. 1, or 400 of FIG. 3. The components include an applications program 510, such as a word processing program, or an add-on to a word processing program, which allows the user to select printing of a meter stamp, as well as the printing of other images (such as a recipient address). The applications program can be accessed by the user in the manner described above with respect to the user interface 600 of FIG. 5. The applications program 510 sends the parameters selected by the user to a printer driver program 520, which can be resident within the memory 320 of the computer 300 of FIG. 1. The printing parameters are sent to the printer driver program as a print file comprising separate electronic representations of the (non-meter stamp) image and the meter stamp. The printer driver program 520 is configured to separate the two components of the print file (the non-stamp image and the meter stamp image), and to transmit the electronic representations of the non-stamp image to the EP print engine program 530. The EP print engine program 530 arranges or formats the electronic representations of the non-stamp image into a format to be printed by the EP imaging section of the EP imagining apparatus (100 of FIG. 1), and the formatted image is then sent to the EP print engine 535 for printing by the EP imaging section.

The electronic representations of the meter stamp (i.e., a "meter stamp print file") are made available by the printer driver program 520 to a meter vault program 540. The meter stamp print file also includes information regarding the value of the postage to be printed as part of the meter stamp. The meter vault program 540 then queries the meter vault memory (220 of FIG. 1) to determine if sufficient postage value is available in the meter vault to print the value requested as part of the meter stamp. The meter vault program 540 can also debit the meter vault by the amount of postage to be printed as part of the meter stamp. When sufficient postage is available in the vault to print the meter stamp, the meter vault program 540 then encrypts or encodes the meter stamp print file and sends it to the meter stamp print engine program 550. If the meter stamp by print engine program 550 recognizes the encrypted or encoded meter stamp print file, the program 550 then arranges or formats the meter stamp file into a format to be printed by the meter stamp printer (e.g., 130 of FIG. 1). The print-formatted meter stamp file is then sent to the meter stamp print engine 555 for printing by the meter stamp printer (here, identified as an ink-jet printer having print head 132 of FIG. 1, or 470 of FIG. 3). Unlike the EP print engine program 530, the meter stamp print engine program 550 is configured to format the meter stamp print file for printing only when the meter stamp print file is properly identified, either by encryption or by encoding. In this manner the EP print engine program 530 cannot be used to print an authorized meter stamp and thus bypass the meter vault accounting routines.

When a communication device, such as interface 330 of FIG. 1, or interface 430 of FIG. 3, is provided, then a postage purchasing application program 560 can be provided to allow postage to be purchased "on-line" from a remote source (360 of FIG. 1, or 480 of FIG. 3). The postage purchasing program 560 communicates with the remote source through a network communication program 570 (as for example, an Internet browser). The postage purchasing program 560 can be used to provide billing information for purchase of the postage, and can receive an encoded message (or it can encode the message) from the remote source verifying that postage has been properly purchased. The encoded message can then be passed by the postage purchasing program 560 to the meter vault program 540. When the meter vault program recognizes that a properly encoded message has been received indicating that postage has been properly purchased, the meter vault program 540 can increment the postage value amount stored in the meter vault memory by the indicated amount. Thus, unless the message provided by the postage purchasing program 560 to the meter vault program 540 is properly encoded, the meter vault program will not increment the postage value stored in the meter vault, helping to avoid fraud.

Turning to FIG. 3, another imaging apparatus 400 is depicted in a schematic diagram. This imaging apparatus can also be used to implement the present invention. The imaging apparatus 400 includes many components which are the same as, or similar to, the EP imaging apparatus 100 of FIG. 1. These components are identified by the same identifier numbers in both figures, and so will not be specifically described with respect to the following description of the imaging apparatus 400 of FIG. 4. The imaging apparatus 400 includes an EP imaging section 122, 124, 126 (as described above with respect to imaging apparatus 100 of FIG. 1), as well as a main processor 402, a memory section 404, a user interface 428, and a network interface 430. However, whereas the meter stamp printer 130 of FIG. 1 is depicted as being integral with the EP imaging apparatus 100, in FIG. 4 the meter stamp printer comprises a separate, detachable attachment 460 which includes the meter stamp printer. This embodiment allows the meter stamp attachment 460 to be connected to the main body 401 of an expandable imaging apparatus by connectors 472. Certain EP imaging apparatuses allow a media discharge tray (such as tray 140 of FIG. 1) to be removed, and an attachment, such as a sorter or a stapler, to be attached to the main body 401 of the imaging apparatus. The meter stamp attachment 460 can be used for such an imaging apparatus, or for any EP imaging apparatus which provides for expansive functionality.

The EP imaging apparatus 400 is depicted as a "stand-alone" device. That is, it is not connected to a separate computer, as for example the computer 300 of FIG. 1. While in certain instances the imaging apparatus can be connected to a computer, for the purposes of the following discussion it will be assumed that the imaging apparatus is not connected to a computer. Rather, user input selections are made with the user input station 428, which includes a display device 429, as well as user input points (buttons) 431. The user input station 428 allows a user to add metered postage to a sheet of media (such as an envelope) to be processed by the imaging apparatus 400.

The meter stamp printing attachment 460, which is used to print a meter stamp on media, includes a media path guide 466 which extends the media path to the media outlet (output tray) 468. Powered rollers 412 can be used to move the printable media past the meter stamp print head 470. The attachment 460 also includes a meter stamp printer, which comprises a print head 470 (such as an ink-jet print head), print head control components 462, and an ink reservoir 464 which can hold the red fluorescent ink used to print metered postage. The print head control components 462 include the electrical, electronic and mechanical components used to move ink from the reservoir 464 to the print head 470, and to manipulate the projection of ink by the print head 470 so as to print a meter stamp in accordance with a predetermined design and postage value. The operation of the print head control components 462 can be controlled by a meter stamp (or meter vault) program, which can be contained within a memory module such as METER MEM 409, and executed by the main processor 402.

The memory device 404 allows expandible memory modules 406 (MEM 1), 407, and 408 (MEM 3) to be added to the imaging apparatus 400 using the memory expansion module interface 405. One of the expansion modules can be a postage meter 407, comprising a meter vault memory 409 and a meter "vault" 411. The meter vault can include a meter vault program, as described above with respect to FIG. 4. In this way, printing of metered postage can be used without the need for a separate postage meter, as item 200 of FIG. 1. The meter memory 409 can store the available value of postage which can be printed by the meter stamp printing unit 460. The meter vault program, stored in the meter vault 411, can be used to provide accounting (debits and credits) to the meter memory 409. The meter vault program can also be used to authorize printing of a meter stamp by the meter stamp printer 460 by encrypting or encoding a meter stamp print file, which is subsequently transmitted to the print head control components 462 for printing of the meter stamp by the meter stamp print head 470. A meter stamp print engine program can also be contained within the print head control components 462, or it can be stored in the meter vault 411. All of the processing of the meter vault program can be performed by the main processor 402.

In this way, a user can select to print an envelope or the like, and add metered postage thereto, using the user interface 428. The user instructions are then transmitted to the main processor 402. An imaging apparatus program (accessed by the main processor 402) can then transmit the information to be imaged by the EP imaging section 122, 124, and 126 to an EP print engine program (530 of FIG. 4), and the meter stamp information to be printed by the meter stamp printer 460 is transmitted to a separate meter stamp print engine program (550 of FIG. 4). As a sheet of media (for example, an envelope "E" in media inlet 112) moves through the media path (defined by guides 116 and 112), the non-stamp image is imaged on the media using an EP imaging process. As the sheet of media is moved into the meter stamp printer attachment 460, the meter stamp is printed on the media using an ink deposition process (such as ink jet printing) using the meter stamp print head 470. The finished product, bearing both the EP image (such as an address) and the meter stamp, is deposited in media outlet (tray) 468.

The communications interface 430 can be used, in conjunction with a postage purchase program (560 of FIG. 4) and a network communications program (570 of FIG. 4), to acquire purchased postage from a remote source 480. The postage purchase program can be stored in the meter vault module 411, and can communicate with the meter vault program (540, FIG. 4) to ensure that only recognized purchased postage is added to the meter vault memory 409.

As can be seen, the various executable program ("software") components of FIG. 4 can be stored in various memory components, and can be executed by different processors in an imaging system. For example, the imaging system 10 has three different processors—imaging apparatus processor 102, computer processor 310, and postage meter vault processor 210—whereas the imaging apparatus 400 of FIG. 3 has only a single processor 402. So long as a meter vault program is provided to ensure that the meter stamp printer only prints metered postage when the security protocols have been confirmed, and so long as the meter vault memory cannot be accessed for crediting of postage other than through the security provided by the meter vault program, then any number of different configurations of components (processors, memory devices and software components) can be arranged to implement the present invention to allow a meter stamp printer to be incorporated into an EP imaging apparatus.

The present invention not only provides for an EP imaging apparatus (such as 100 of FIG. 1, or 400 of FIG. 3) which incorporates a meter stamp printer (130, 460, respectively), but the invention also provides for an attachment (as 460, of FIG. 3) for an electrophotographic imaging apparatus (as 400, FIG. 3) to allow the EP imaging apparatus to also print metered postage. As described above, the EP imaging apparatus comprises an electrophotographic imaging section capable of generating an image (i.e., a non-meter stamp image) on media using an electrophotographic imaging process. The meter stamp attachment 460 comprises a meter stamp printer (462, 470) capable of printing a meter stamp on the media. Preferably, the print head 470 is an ink jet print head. The meter stamp printer 460 can also comprise a meter stamp print engine which, as described above, can be the print engine 550 of FIG. 4, and which can be in the form of a software program stored in the print head control components 462, or in a separate memory location, such as the meter vault 411 of FIG. 3. As previously described, the meter stamp print engine is configured to cause the print head 470 to print a meter stamp upon receipt of an instruction from a meter vault program (such as meter vault program 540 of FIG. 4).

Figure 6:
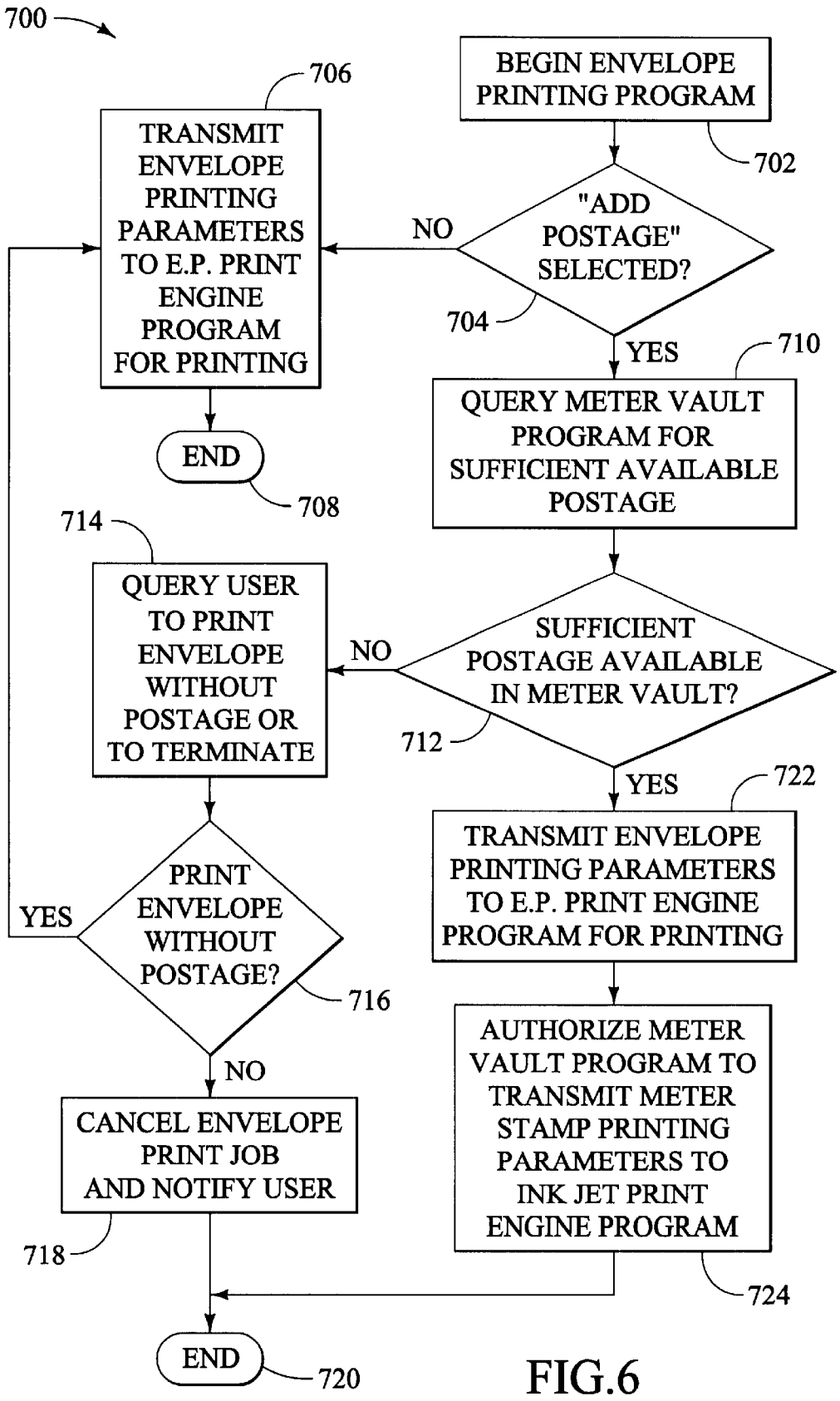
FIG. 6 is a depiction of a flow chart showing the steps of printing an envelope with a meter stamp in accordance with the present invention.

Turning to FIG. 6, a flow chart 700 is shown which depicts the steps of an exemplary "envelope printing program" which can be used to implement the present invention. The steps of the program depicted in the flow chart 700 can be implemented by a set of computer executable instructions, which can be executed by a processor, such as processor 310 of FIG. 1, to implement the program. The steps of the flow chart can be incorporated into one or more of the "software" components identified in FIG. 4. The exemplary process depicted in FIG. 6 is for the printing of an envelope. However, it should be understood that the process can also be applied to the printing of any media such as a label or a postcard) which can bear metered postage.

The envelope printing program 700 begins at step 702, when a user makes a selection to print an envelope. This can be accomplished when a user selects the PRINT button 642 of FIG. 5, using an applications program such as 510 of FIG. 4. The program then queries at step 704 whether "ADD POSTAGE" (selection 630 of FIG. 5, for example) has been selected. If not, then the program proceeds to step 706, wherein the envelope printing parameters (e.g., recipient address and return address) are 8 transmitted to the electrophotographic print engine program (e.g., 530, FIG. 4) for printing of the envelope using only the EP printing components (e.g., 122, 124) of FIG. 1). Thereafter the envelope printing program ends at step 708.

However, if at step 704 the program determines that the user desires to print metered postage on the envelope, then at step 710 the program queries the meter vault program (e.g., 540 of FIG. 4) whether there is sufficient postage in the meter vault (e.g., meter vault memory 220, FIG. 1) to add the requested postage to the envelope. Following the query, at step 712 if it is determined that there is not sufficient postage value in the meter vault, then at step 714 the user is notified that there is insufficient postage available, and the user is queried if she still wishes to print the envelope, albeit without the meter stamp. If, at step 716, the user determines that she does not wish to print the envelope without the meter stamp, then at step 718 the envelope printing job is cancelled, and the processes ends at step 720. However, if at step 716 the user requests printing of the envelope, even without the metered postage, then the program proceeds to step 706 to print the non-meter stamp parameters of the envelope (using the EP imaging components only) in the manner described above.

If at step 712 it is determined that there is sufficient postage available in the meter vault to print the requested metered postage on the envelope, then at step 722 the envelope printing program transmits the non-meter stamp envelope printing parameters (e.g., recipient address and return address) to the EP print engine program (e.g., 530, FIG. 4) for printing by the EP imaging components. Then at step 724 the printer program 700 authorizes the meter vault program (e.g., 540, FIG. 5) to transmit the meter stamp printing parameters to the meter stamp print engine program (e.g., 550 of FIG. 4, wherein the meter stamp printer is an ink jet printer) so that the meter stamp can be printed by the separate meter stamp printer. Both the non-meter stamp parameters and the meter stamp parameters having now been transmitted for printing by the respective EP printing components and the meter stamp printing components, the program ends at step 720.

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An imaging apparatus comprising:

an electrophotographic imaging section capable of generating an image on media using an electrophotographic imaging process; and a meter stamp printer capable of printing a meter stamp on the media; and wherein the meter stamp printer comprises a meter stamp unit detachably connectable to the imaging apparatus.

2. An imaging apparatus comprising:

an electrophotographic imaging section capable of generating an image on media using an electrophotographic imaging process; and a meter stamp printer capable of printing a meter stamp on the media;

an electrophotographic print engine configured to generate the image on the media using the electrophotographic imaging section, and wherein the meter stamp printer comprises a meter stamp print engine and a meter stamp print head responsive to the meter stamp print engine and configured to print the meter stamp on the media;

a main processor, a meter vault comprising a meter vault memory, and a meter vault program, and wherein:

the meter vault memory is configured to store a value of postage which can be printed by the meter stamp printer;

the meter vault program is configured to authorize the printing of the meter stamp on the media using the meter stamp printer; and the main processor is configured to generate the image on the media using the electrophotographic print engine;

the imaging apparatus further comprising a meter stamp program configured to assist in providing security to the vault memory, and wherein the meter stamp program is stored in the meter vault memory.

3. An imaging system comprising:

an imaging device comprising an electrophotographic imaging section capable of generating an image on media using an electrophotographic imaging process, and a meter stamp printer capable of printing on the media a meter stamp defined by a stamp value;

a postage meter comprising a meter vault for storing a value of postage which can be printed by the meter stamp printer; and a computer configured to allow a user to instruct the imaging device to generate an image on the media using the electrophotographic imaging section, to print a meter stamp on the media using the meter stamp printer, and to obtain the stamp value from the meter vault; and wherein the meter stamp printer comprises a meter stamp unit detachably connectable to the imaging device.

4. An imaging system comprising:

an imaging device comprising an electrophotographic imaging section capable of generating an image on media using an electrophotographic imaging process, and a meter stamp printer capable of printing on the media a meter stamp defined by a stamp value;

a postage meter comprising a meter vault for storing a value of postage which can be printed by the meter stamp printer; and a computer configured to allow a user to instruct the imaging device to generate an image on the media using the electrophotographic imaging section, to print a meter stamp on the media using the meter stamp printer, and to obtain the stamp value from the meter vault; and wherein the imaging device further comprises an imaging device processor and an expansion module interface, and further wherein the postage meter comprises a module configured to be received within the expansion module interface.

5. An attachment for an electrophotographic imaging apparatus, the imaging apparatus comprising an electrophotographic imaging section capable of generating an image on media using an electrophotographic imaging process, the attachment comprising a meter stamp printer capable of printing a meter stamp on the media.

6. The attachment for an electrophotographic imaging apparatus of claim 5, and wherein the meter stamp printer comprises an ink jet print head.

7. The attachment for an electrophotographic imaging apparatus of claim 6, and wherein the meter stamp printer comprises a meter stamp print engine, and wherein the meter stamp print engine is configured to cause the ink jet print head to print the meter stamp upon receipt of an instruction from a meter vault program.

* * * * *